US007124920B2

(12) United States Patent
Gustafson et al.

(10) Patent No.: US 7,124,920 B2
(45) Date of Patent: Oct. 24, 2006

(54) HANGER ATTACHMENT

(76) Inventors: Dana Mark Gustafson, P.O. Box 1307, Chester, CA (US) 96020; Matthew Stein, 782 Lahina Pl., Kihei, HI (US) 96753

( * ) Notice: Subject to any disclaimer, the term of this patent is extended or adjusted under 35 U.S.C. 154(b) by 0 days.

(21) Appl. No.: 10/286,003

(22) Filed: Oct. 31, 2002

(65) Prior Publication Data

US 2004/0084488 A1 May 6, 2004

(51) Int. Cl.
*A41D 27/22* (2006.01)

(52) U.S. Cl. ..... 223/98

(58) Field of Classification Search ..... 223/85, 223/88, 92, 95, 97, 98; 211/85.3; D6/319, D6/328

See application file for complete search history.

(56) References Cited

U.S. PATENT DOCUMENTS

| | | | | | |
|---|---|---|---|---|---|
| 2,335,285 | A | * | 11/1943 | Kinney | 223/89 |
| 2,591,163 | A | * | 4/1952 | Kivett | 223/98 |
| 2,884,171 | A | * | 4/1959 | Knuth | 223/98 |
| 2,910,215 | A | * | 10/1959 | Auten | 223/98 |
| 2,960,262 | A | * | 11/1960 | Cavender | 223/98 |
| 3,039,662 | A | * | 6/1962 | Strong | 223/89 |
| 3,301,447 | A | * | 1/1967 | Felton | 223/98 |
| 4,632,287 | A | * | 12/1986 | Bevelander | 223/98 |
| 5,613,627 | A | * | 3/1997 | Marks | 223/85 |
| 6,138,880 | A | * | 10/2000 | Williams | 223/98 |

* cited by examiner

*Primary Examiner*—Gary L. Welch
(74) *Attorney, Agent, or Firm*—Sierra Patent Group, Ltd.

(57) ABSTRACT

The patent is for certain developments in hanger technology. Particularly attachments to provide broader shoulder supports for wood wire and plastic hangers and combinations thereof.

7 Claims, 7 Drawing Sheets

HANGER ATTACHMENT

BACKGROUND

1. Field of Invention

This invention relates generally to the field of clothes hangers.

2. Description of the Prior Art

Wooden and wire hangers have been the state of the art for many years. Recently plastic molded hangers have made an entrance into suits and round cross section plastic hangers have become available. Narrow hangers, plastic or wire and even old wooden hangers can cause indentations on the shoulders of garments from their weight being held over ends thereof. These indentations can cause stretching imperfections in clothing. Men's suits for larger shoulder dimensions can be a particular problem. Fine fabrics such as rayon and silks can be damaged by the indentations.

The Applicant's invention overcomes the shortcomings of the prior art.

BRIEF DESCRIPTION OF PREFERRED EMBODIMENTS

Figure 1:
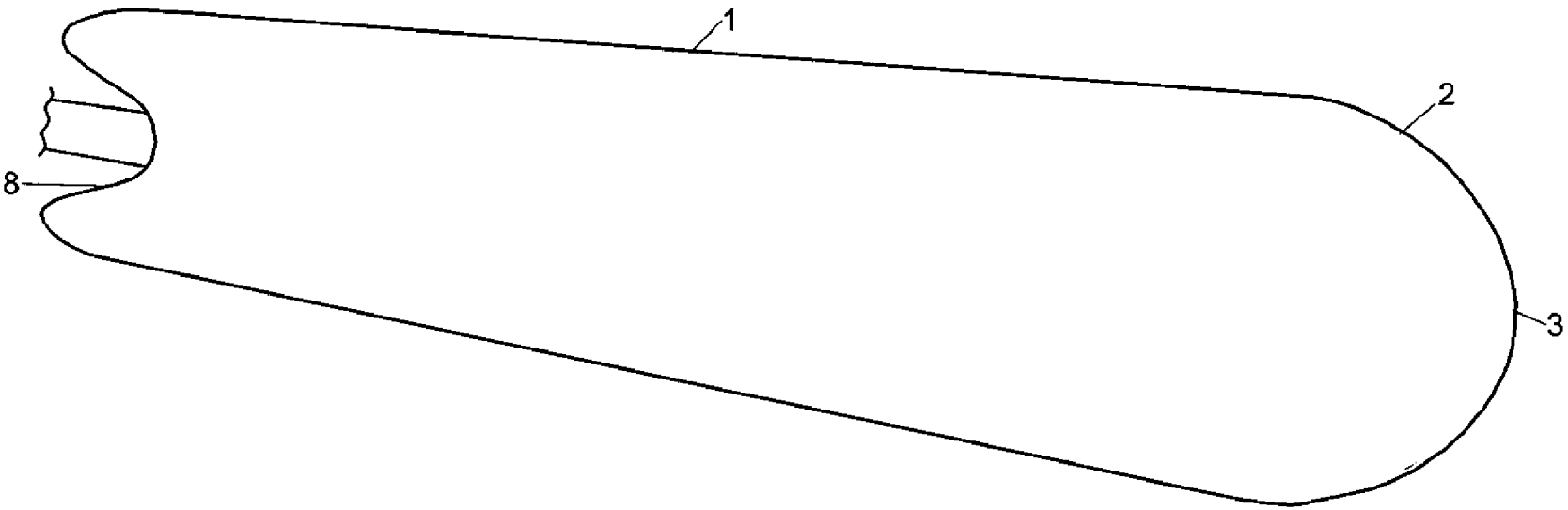
FIG. 1 A top view of the Device
FIG. 2 An end view of the Device
FIG. 3 A bottom view of the Device
FIG. 4 A bottom view of a second embodiment.
Figure 2:
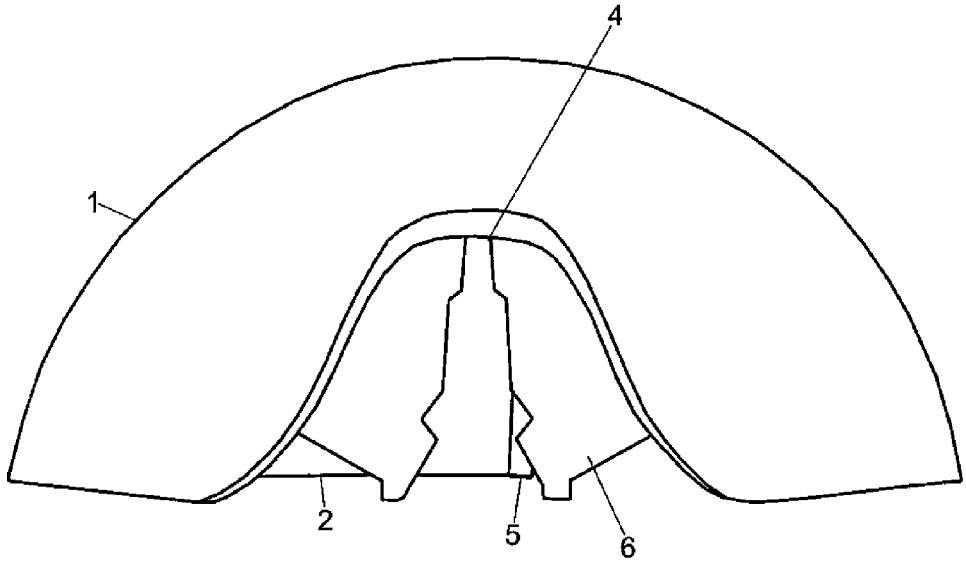
Figure 3:
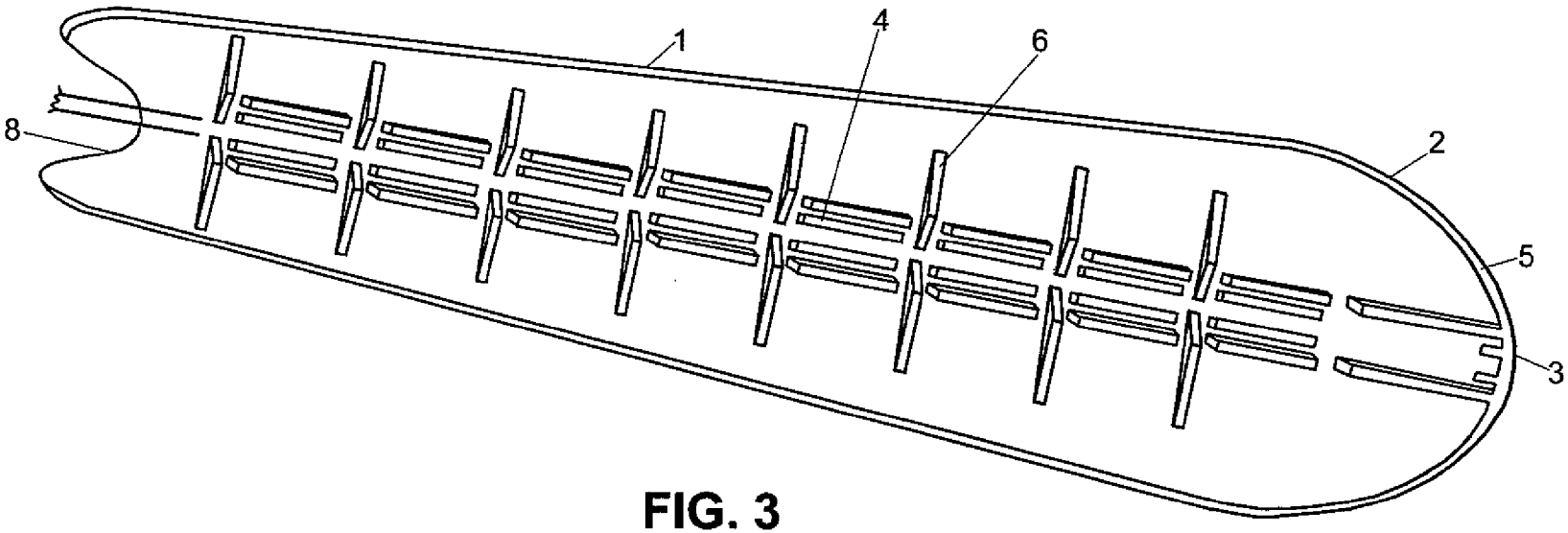
Figure 6:
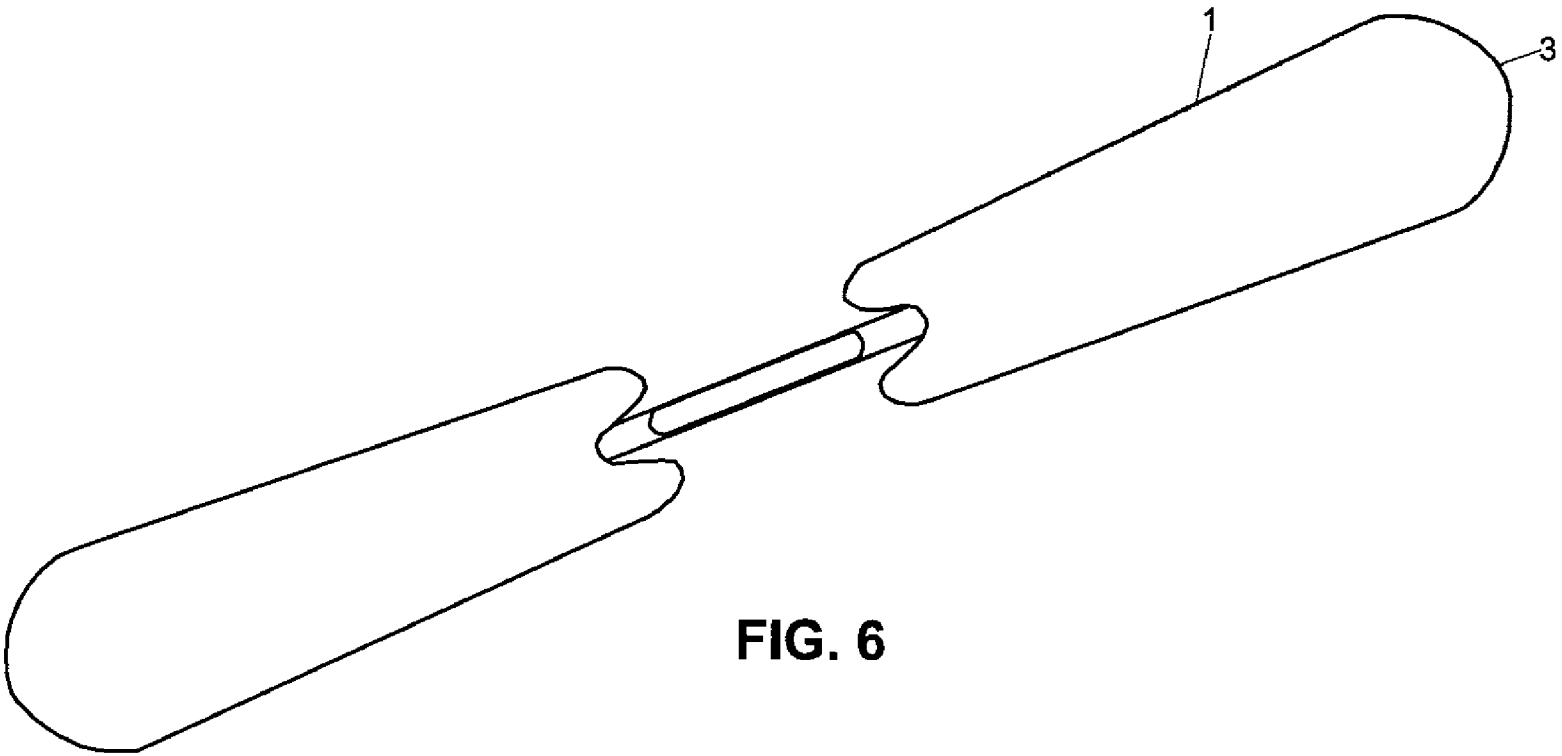
Figure 7:
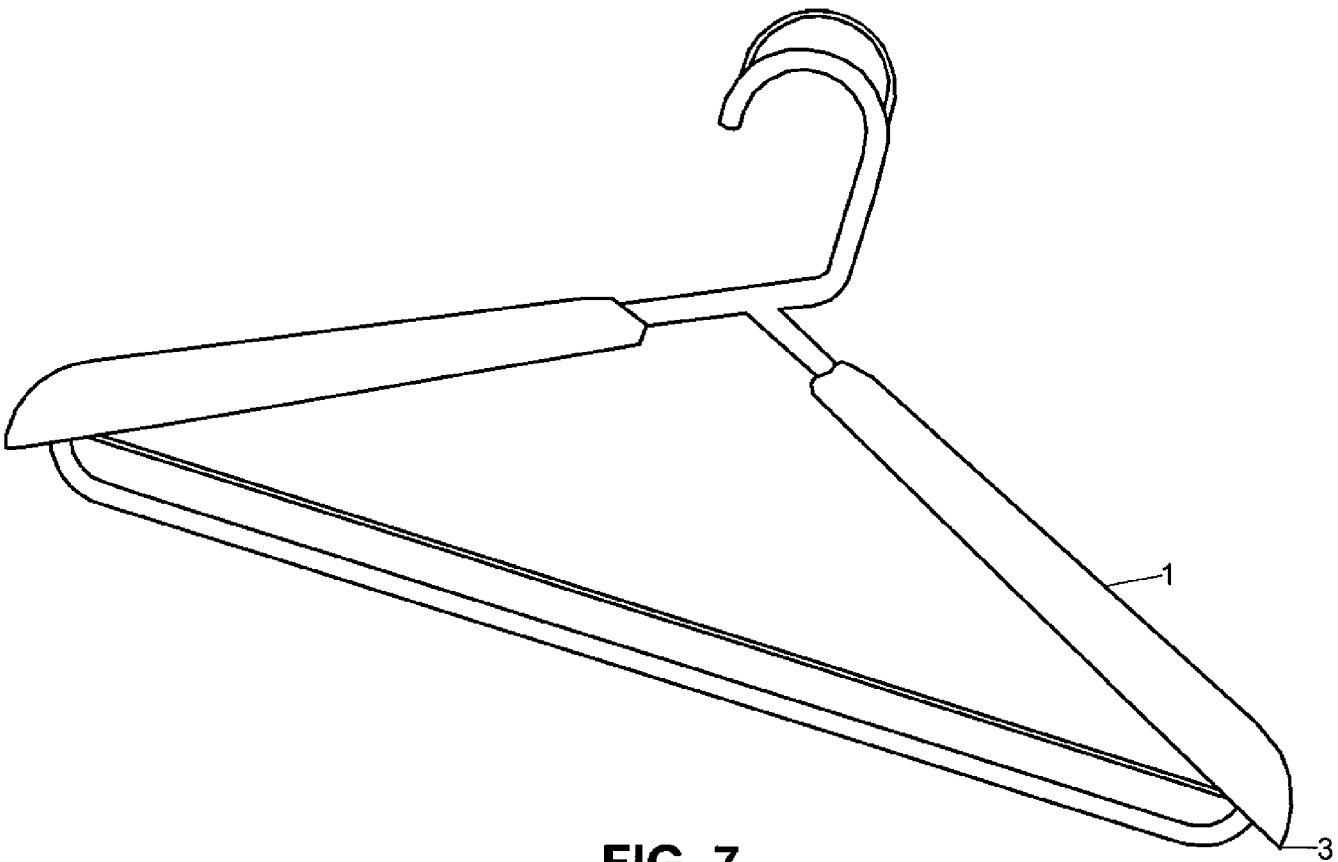
FIG. 7 A top view in situ of the Device

FIG. 1 shows a top view of the device 1 at an outside end 2. The device 1 widens and has a substantially radiused terminus 3. FIG. 2 and FIG. 3 is a bottom view showing wire guides 4 on a central cord of the device 1. These wire guides 4 include parallel guides distanced apart so as to allow the wire to snap into place. Note that at the radiused terminus 3 the secondary guides 5 are longer to provide rotational stability for the wire hanger installation. Lateral detents 6 can accept plastic hangers which have a range of diameters. Notches 8 on the end opposite terminus 3 can't accept hanging straps for women's clothing. FIG. 6 and FIG. 7 show the device in situ on hangers.

Figure 4:
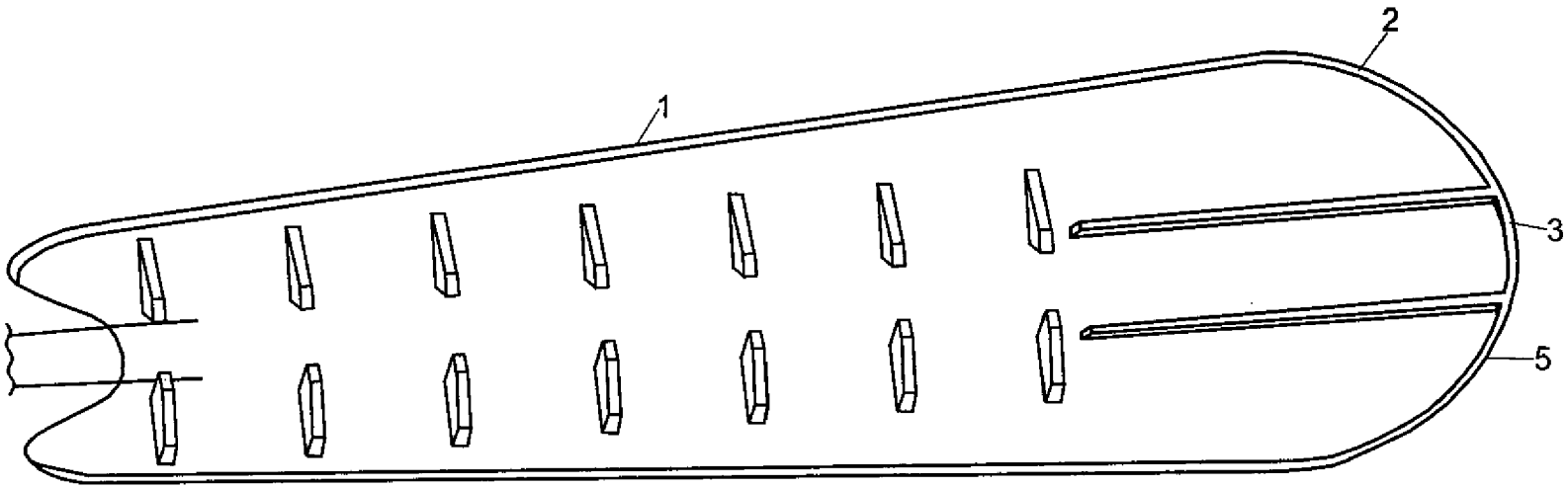
Figure 5:
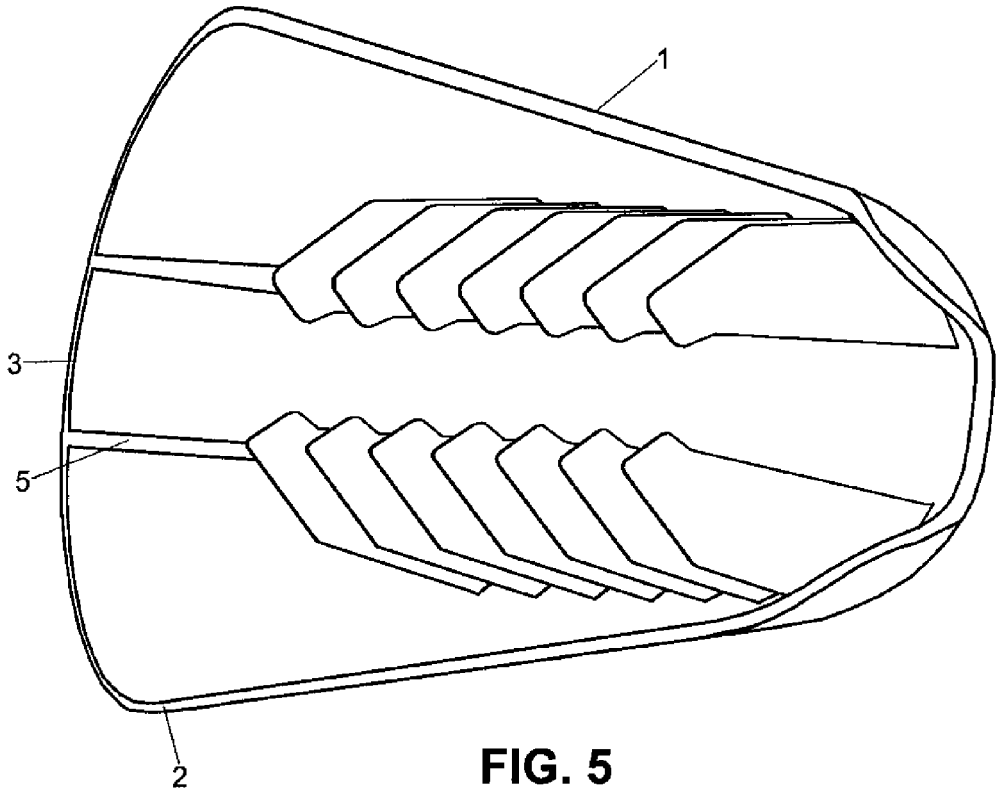
FIG. 5 An end view of a second embodiment
FIG. 6 A perspective view in situ of the Device.

In another embodiment, the invention includes fingers as shown in FIGS. 4 and 5 for attaching to wood hangers. The fingers are biased to engage the wooden hanger between them.

The device is made of a plastic material to be light weight and so as not to stain or mark the clothing in any way. The top surface 7 of the device 1 is uniform so that the clothing doesn't get snagged or cut on any deformations in the device 1.

Obviously, numerous (additional) modifications and variations of the present invention are possible in light of the above teachings. It is, therefore, to be understood that the invention may be practiced otherwise than as specifically described herein.

The invention claimed is:

1. A hanger attachment device for retrofitting clothing hangers comprising a uniform surfaced member having a substantially half tubular cross section and a semi-spherical terminus further comprising at least two clips within said tubular cross section for holding a hanger further comprising means for holding a second type of hanger of a different cross section such that said hangers comprising at least two hanger diameters can be used interchangeably.

2. An apparatus described in claim 1 further comprising means for rotational support to resist rotation of said member about a hanger.

3. An apparatus described in claim 1 wherein said clips comprise a pair of integral members separated a distance less than a diameter of said hanger apart such that the hanger is forced between said pair and the pair deform slightly then return to retain said hanger.

4. An apparatus described in claim 1 wherein said attachment device comprises means for holding hanging straps for women's clothing.

5. An apparatus described in claim 4 wherein said means for holding comprises a slot at an end opposite said terminus end of said device.

6. An Apparatus as described in claim 1 further comprising at least three clips for holding a hanger wherein said attachment device further comprises means for holding hanging straps for women's clothing.

7. An apparatus as described in claim 1 further comprising means for holding a strap supported directly by said hanger but prevented from slipping by an end of said device.

* * * * *